United States Patent [19]

Malancon, Jr.

[11] Patent Number: 4,691,822

[45] Date of Patent: Sep. 8, 1987

[54] CONTAINER AND HOLDER FOR DISPENSING BAKING SODA

[76] Inventor: Irvin P. Malancon, Jr., P.O. Box 383, Cut Off, La. 70345

[21] Appl. No.: 849,261

[22] Filed: Apr. 7, 1986

[51] Int. Cl.[4] ..... B65D 69/00

[52] U.S. Cl. ..... 206/229; 248/205.3; 248/311.2; D9/374; 220/94 A; 206/806; 206/822; 206/525; 222/465.1

[58] Field of Search ..... 248/205.3, 311.2; 222/465 R; D9/71, 374; 220/94 A; 206/229, 361, 486, 806, 822, 525

[56] References Cited

U.S. PATENT DOCUMENTS

| | | | |
|---|---|---|---|
| 1,632,540 | 6/1927 | Clarke . | |
| 2,044,985 | 6/1936 | Holmberg | 206/361 |
| 2,187,245 | 1/1940 | Nerney | 65/45 |
| 3,159,367 | 12/1964 | Kendle | 248/311.2 |
| 3,165,252 | 1/1965 | Carter et al. | 220/94 A |
| 3,214,052 | 10/1965 | Dike | 220/94 A |
| 3,307,752 | 3/1967 | Anderson | 222/465 |
| 3,426,989 | 2/1969 | Dgetluck | 206/361 |
| 3,516,801 | 6/1970 | Shah | 248/311.2 |
| 4,044,836 | 8/1977 | Martin | 169/30 |
| 4,175,680 | 11/1979 | Sammut | 222/465 |
| 4,339,837 | 7/1982 | Reeberg | 200/361 |
| 4,431,154 | 2/1984 | Hamm | 248/215 |

*Primary Examiner*—Joseph Man-Fu Moy
*Attorney, Agent, or Firm*—David L. Ray

[57] ABSTRACT

A container and holder assembly especially adapted for containing baking soda including a hollow container adapted to be mounted in a vertical position, the container having an elongated, generally cylindrical handle of sufficient diameter to be easily grasped by the hand of the user, the elongated handle having an enlarged, generally rectangular upper portion integrally molded therewith having a threaded spout thereon and a cap which threads on said spout connected to a planar section on the upper end of the rectangular portion located at an angle with the longitudinal axis of the container. The container is made from a translucent or transparent material which permits visual observation of the amount of the level of contents which in the container. The holder is adapted for quick and easy attachment to the inside or outside of a kitchen cabinet door or other vertical panel, and holds the container in a vertical position with the handle of the container extending beneath the holder, the holder gripping the lower end of the enlarged rectangular portion of the container.

19 Claims, 7 Drawing Figures

CONTAINER AND HOLDER FOR DISPENSING BAKING SODA

BACKGROUND OF THE INVENTION

1. Field of the Invention

The present invention relates to a container for dispensing baking soda and a holder for mounting the container in a convenient location. More particularly, the present invention relates to a container for quickly and easily dispensing baking soda onto a fire to extinguish the fire and a holder for the container which is connectable to a cabinet or cabinet door located adjacent to a stove on which a potential fire may occur, the holder permitting quick removal of the container therefrom.

2. Description of the Prior Art

Numerous dispensing containers and holders therefor known in the prior art. Exemplary of such containers and holders are those described in the following U.S. Patents:

U.S. Pat. Nos. 4,431,154 discloses a holder for mounting on a rail and the like including a body forming a receptacle and having a body back wall. The holder includes a bracket attached to the body back wall which forms a receiver therewith and a clip removably attached to the body. The holder is used to hold patient communicators or other items.

U.S. Pat. No. 4,175,680 discloses a container for dispensing powder or granulated material. The container includes top, bottom, side and end walls with the top of the container having a handle and a filling spout communicating with the interior of the container. The bottom of the container is provided with a closure member which may be removed from the closed position for the purpose of dispensing the contents of the container.

U.S. Pat. No. 4,044,836 discloses a dispenser for dry powder, and in particular for fire extinguishing powders, formed as a container having a handle/nozzle section to be gripped by one hand, a hand gripping section to be gripped by the other hand and a central bellows section for alternate axial compression and expansion to pump the powder from the container and thereby to discharge it in repeated cloud like bursts.

U.S. Pat. No. 3,307,752 discloses a container closure for use with spouted containers for holding liquids. The closure includes a specially shaped double wall cap structure which cooperates with the spouted opening of container and which may be easily opened.

U.S. Pat. No. 2,187,245 discloses a container for various condiments having a relatively long handle and a bowl portion formed integrally therewith. The bowl has grooved side walls, a scoop edge portion and a separate distributing portion having a plurality of openings therein.

U.S. Pat. No. 1,632,540 discloses a dispenser for fertilizers including a container having a closed top end provided with a handle and a bottom provided with a open neck, a disk having apertures therein adapted to seat over the neck, and a screw cap having apertures adapted to mount on the disk on the neck and to be adjusted to bring its apertures into or out of registration with the apertures in the disk.

It is an object of the present invention to provide a dispensing container for baking soda and a holder therefor which permits the container to be quickly and easily mounted on a wall or the inside of a cabinet door of a kitchen cabinet. The container is then available for use in extinguishing fires in cooking vessels on a kitchen stove such as grease fires.

It is another object of the present invention to provide a container for mounting on the inside wall of a kitchen cabinet or at other locations in a kitchen which is transparent or translucent thereby allowing a rapid visual determination of the amount of baking soda contained in the container.

It is another object of the present invention to provide a dispensing container for baking soda which keeps baking soda dry and out of contact with the atmosphere, and permits quick and easy dispensing of the baking soda for use in baking and other kitchen operations.

SUMMARY OF THE INVENTION

In accordance with the present invention there is provided a container and holder assembly especially adapted for containing baking soda including a hollow container adapted to be mounted in a vertical position, the container having an elongated, generally cylindrical handle of sufficient diameter to be easily grasped by the hand of the user, the elongated handle having an enlarged, generally rectangular upper portion integrally molded therewith having a threaded spout thereon and a cap which threads on said spout, connected to a planar section on the upper end of the rectangular portion located at an angle with the longitudinal axis of the container. The container is made from a translucent or transparent material which permits visual observation of the amount of the level of contents which in the container. The holder is adapted for quick and easy attachment to the inside or outside of a kitchen cabinet door or other vertical panel. The holder is adapted to hold the container in a vertical position with the handle of the container extending beneath the holder, the holder gripping the lower end of the enlarged rectangular portion of the container.

The container and holder assembly of the present invention provides an inexpensive container for baking soda which permits rapid application of baking soda to a fire occurring on a kitchen stove or at another location. Furthermore, the container and holder assembly of the present invention provides rapid visual determination of the amount of baking soda in the container. In addition, the container and holder assembly of the present invention provides a container for baking soda that prevents baking soda from absorbing moisture from the atmosphere surrounding the container by the provision of a spout having threads thereon and a cap which may be screwed onto the spout.

BRIEF DESCRIPTION OF THE DRAWINGS

The container and holder assembly of the present invention may be more easily understood by reference to the drawings in which.

DESCRIPTION OF THE PREFERRED EMBODIMENTS

Figure 1:
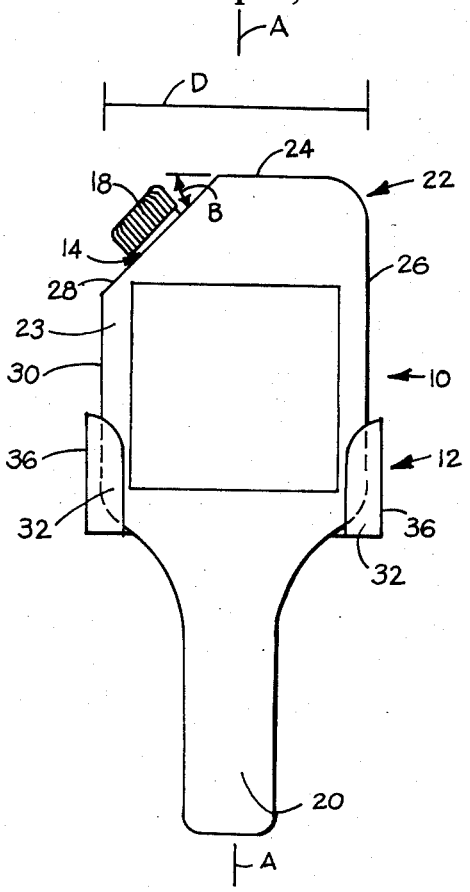
FIG. 1 is a front elevational view of the container and holder assembly of the present invention.
Figure 2:
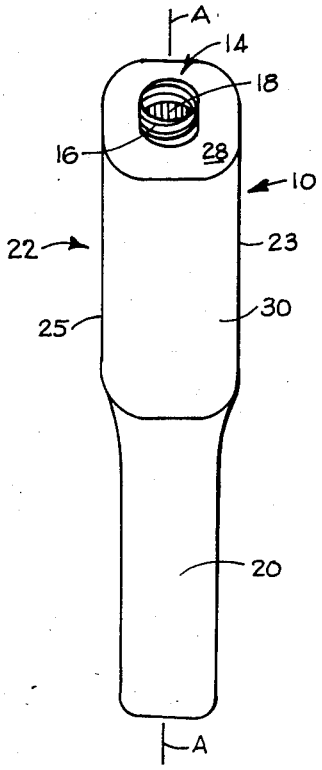
FIG. 2 is a side elevational view of the container of the present invention.

Referring now to FIG. 1, the container of the present invention is generally indicated by the numeral 10 and the holder of the present invention is generally indicted by the numeral 12. Container 10 and holder 12 are each integrally molded from a single material. Container 10 is hollow inside and has a spout generally indicated by the numeral 14 on the upper end thereof having threads 16 thereon as can be seen in FIG. 2. An internally threaded cap 18 is adapted to thread on threaded spout 14.

Figure 4:
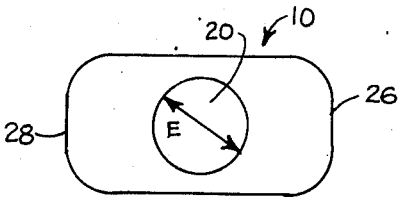
FIG. 4 is a bottom plan view of the container of the present invention.

Container 10 has a tapered handle portion 20 which can be seen in FIG. 4 to have a generally circular cross section which may be easily grasped by the hand of the user. Integrally formed with handle section 20 is the upper rectangular portion generally indicated by the numeral 22 which has a horizontal generally rectangular top section 24 which is generally perpendicular to rectangular side walls 26 and 30 of container 10 and to front wall 23 and back wall 25 of container 10. Rectangular side walls 26, and 30 are parllel to and equidistant from the longitudinal axis A—A of container 10, as are front wall 23 and back wall 25.

Sloping downwardly from horizontal generally rectangular top 24 is a generally rectangular planar section 28 which forms an angle B with horizontal generally rectangular top section 24. Angle B may vary from about 40° to about 50° but is preferably about 45°. A shorter vertical side wall 30 is parallel to side wall 26 and is generally rectangular in shape.

Figure 6:
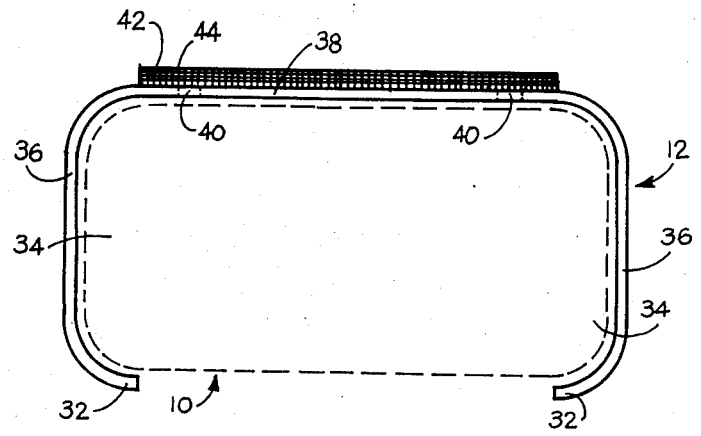
FIG. 6 is a front elevation of the holder of the present invention showing a portion of the container and holder in phantom lines.
Figure 5:
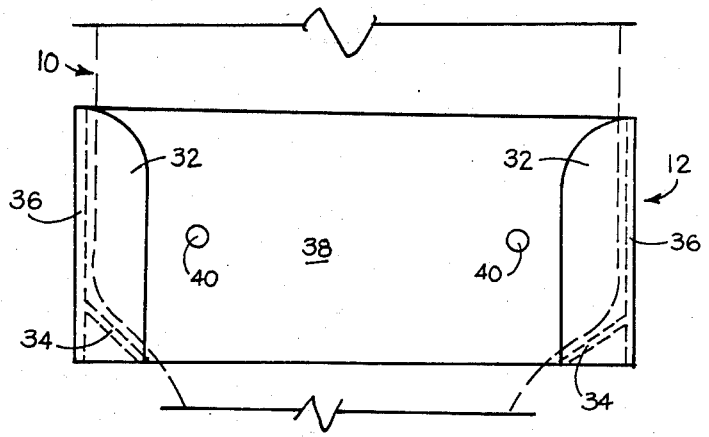
FIG. 5 is a top plan view of the container holder of the present invention showing a cross section of the container in phantom lines.
Figure 7:
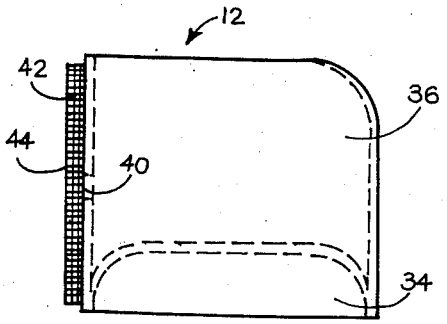
FIG. 7 is a top view of the holder of the present invention.

Holder 12 is shown in greater detail in FIGS. 5 through 7. Holder 12 has two curved retaining wings 32—32 on the front thereof. Wings 32—32 have lower sloping lips 34—34 on the sides thereof upon which the generally cylindrical portion 22 of container 10 rests. Wings 32—32 are connected by two side walls 36 which are generally parallel to backwall 38. Backwall 38 is generally perpendicular to side walls 36. Backwall 38 is generally rectangular in shape and has at least two holes 40—40 therein through which may be inserted screws, bolts, or the like for fastening holder 12 to a cabinet door.

Preferably, a piece of tape 42 is connected to the back wall 38 of holder 12 by gluing, cementing or the like. Tape 42 has an outer exterior wall 44 having glue, cement or other adhesive coating thereon for attachment of the tape to a cabinet door. Thus, holder 12 may be connected to a cabinet door by either tape 44 or by the use of screws or bolts inserted through hole 40, or both.

Figure 3:
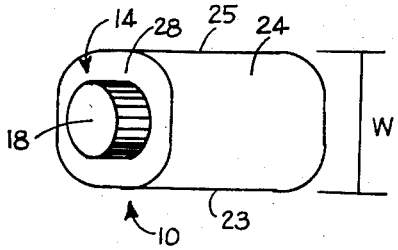
FIG. 3 is a top plan view of the holder of the present invention.

It is important that the outside diameter D of the upper portion 22 of container 10 shown in FIG. 1 be larger than the diameter E shown in FIG. 4 of handle portion 20. Preferably, length D is twice as large as diameter E, or D may be equal from about 1.5E to about 3E. The width W shown in FIG. 3 may be equal to E or may vary from about 1.1E to about 1.5E.

The container of the present invention is preferably made of a transparent or translucent material so that the amount of product in the container may be visually observed without the necessity of opening the container. Thus, the user can visually inspect the container to determine immediately the level of product in the container and may replace baking soda or other product in the container as needed and desired. The container is preferably is made from a plastic polymer, although the container could be made from glass.

The holder may be made of a plastic polymer or metal and may be opaque. If desired, a label 50 may be placed on the outside of the container as shown in FIG. 1 bearing any message or logo desired by the manufacturer of the container.

Although the preferred embodiments of the present invention have been disclosed and described in detail above, it should be understood that the invention is in no sense limited thereby, and its scope is to be determined by that of the following claims.

What is claimed is:

1. A container and holder assembly for containing and dispensing baking soda comprising:

a. a hollow container body means for holding baking soda adapted for mounting in a vertical position, said container body means having an elongated, generally cylindrical handle axially aligned with a generally rectangular upper portion integrally molded with said handle, said upper portion having spout means integrally molded therewith, said upper portion having two generally vertical sidewalls parallel to each other and to the longitudinal axis of said container body means, said upper portion having a front wall and a back wall parallel to each other and to the longitudinal axis of said container, said upper portion having a generally rectangular top section perpendicular to said longitudinal axis of said container body means, said upper portion having a sloping planar section connected to said top section and forming an angle B therewith, said spout means being located on said planar section, and b. holder means for slidably receiving said container body means.

2. The assembly of claim 1 wherein said holder means comprises:

a. back wall means having a front face and a back face, b. two spaced apart parallel side walls means extending perpendicularly from said front face said back wall means, c. wing means connected to each of said sidewall means and extending perpendicularly therefrom, said wing means being parallel to said backwall means for receiving said container body means, and d. lip means connected to said wing means, said sidewall means, and said backwall means for supporting said container body means.

3. The assembly of claim 2 wherein said back wall means has a plurality of holes therein for receipt of fastening means for fastening said holder means to a vertical body.

4. The apparatus of claim 2 wherein said backwall means has tape means connected to the back face thereof for fastening said holder means to a vertical body.

5. The assembly of claim 2 wherein said angle B is from about 40° to about 50°.

6. The assembly of claim 2 wherein said angle B is about 45°.

7. The assembly of claim 1 wherein the length D of said upper rectangular portion is from about 1.5 to about 3.0 times the diameter of said elongated generally cylindrical handle.

8. The assembly of claim 1 wherein the length D of said upper rectangular portion is twice the diameter of said elongated generally cylindrical handle.

9. The assembly of claim 1 wherein the width W of said upper rectangular portion is from about 1.1 to about 1.5 times the diameter of said elongated generally cylindrical handle.

10. The assembly of claim 1 wherein the width W of said upper rectangular portion is equal to the diameter of said elongated generally cylindrical handle.

11. The assembly of claim 1 wherein said vertical sidewalls are generally rectangular in shape.

12. The assembly of claim 11 wherein said planar section is generally rectangular in shape.

13. A container and holder assembly for containing and dispensing baking soda comprising:

a. a hollow container body means for holding baking soda adapted for mounting in a vertical position, said container body means having an elongated, generally cylindrical handle axially aligned with a generally rectangular upper portion integrally molded with said handle, said upper portion having spout means integrally molded therewith, said upper portion having two generally vertical sidewalls parallel to each other and to the longitudinal axis of said container body means, said upper portion having a front wall and a back wall parallel to each other and to the longitudinal axis of said container, said upper portion having a generally rectangular top section perpendicular to said longitudinal axis of said container body means, said upper portion having a sloping planar section connected to said top section and forming an angle B therewith, wherein said angle B is from about 40° to about 50°, said spout means being located on said planar section, wherein the length D of said upper rectangular portion is from about 1.5 to about 3.0 times the diameter of said elongated generally cylindrical handle, and the width W of said upper rectangular portion is from about 1.1 to about 1.5 times the diameter of said handle, and b. holder means for slidably receiving said container body means, said holder means having:

i. back wall means having a front face and a back face, ii. two spaced apart parallel side walls means extending perpendicularly from said front face of said back wall means, iii. wing means connected to each of said sidewall means extending perpendicularly therefrom, said wing means being parallel to said backwall means for receiving said container body means, and iiii. lip means connected to said wing means, said sidewall means, and said backwall means for supporting said container body means.

14. The assembly of claim 13 wherein said back wall means has a plurality of holes therein for receipt of fastening means for fastening said holder means to a vertical body.

15. The apparatus of claim 13 wherein said backwall means has tape means connected to the back face thereof for fastening said holder means to a vertical body.

16. The assembly of claim 13 wherein said angle B is about 45°.

17. The assembly of claim 13 wherein the width W of said upper rectangular portion is equal to the diameter of said handle.

18. The assembly of claim 13 wherein said vertical sidewalls are generally rectangular in shape.

19. The assembly of claim 18 wherein said planar section is generally rectangular in shape.

* * * * *